US008185037B2

(12) United States Patent
Kimijima

(10) Patent No.: US 8,185,037 B2
(45) Date of Patent: May 22, 2012

(54) SHEET FEEDING DEVICE AND IMAGE FORMING APPARATUS INCLUDING THE SAME

(75) Inventor: Masashi Kimijima, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 449 days.

(21) Appl. No.: 12/585,099

(22) Filed: Sep. 3, 2009

(65) Prior Publication Data

US 2010/0061785 A1 Mar. 11, 2010

(30) Foreign Application Priority Data

Sep. 6, 2008 (JP) ..... 2008-229153

(51) Int. Cl.
*G03G 15/00* (2006.01)

(52) U.S. Cl. ..... 399/389; 399/391

(58) Field of Classification Search ..... 399/389
See application file for complete search history.

(56) References Cited

U.S. PATENT DOCUMENTS

| | | | | |
|---|---|---|---|---|
| 4,702,589 | A * | 10/1987 | Ito | 399/390 |
| 5,172,903 | A * | 12/1992 | Haneda et al. | 271/171 |
| 5,484,140 | A | 1/1996 | Hirose et al. | |
| 5,537,195 | A * | 7/1996 | Sagara et al. | 399/381 |
| 5,771,433 | A | 6/1998 | Kimijima | |
| 6,985,265 | B2 * | 1/2006 | Ito | 358/400 |
| 7,044,666 | B2 * | 5/2006 | Takahashi et al. | 400/624 |
| 7,758,040 | B2 * | 7/2010 | Hashimoto et al. | 271/145 |
| 2006/0180988 | A1 | 8/2006 | Yorimoto et al. | |

FOREIGN PATENT DOCUMENTS

| | | |
|---|---|---|
| JP | 60-242139 | 12/1985 |
| JP | H06-001349 | 1/1994 |
| JP | 2004-315231 | 11/2004 |

* cited by examiner

*Primary Examiner* — Anthony Nguyen
(74) *Attorney, Agent, or Firm* — Harness, Dickey & Pierce, PLC

(57) ABSTRACT

A sheet feeding device including a sheet feed cassette. The sheet feed cassette includes a tray extendable and contractible in a direction of sheet feed; a guide member having a long groove provided on a bottom plate of the sheet feed cassette in the direction of sheet feed; a pressing member having a shaft in a lower portion thereof loosely inserted into the guide member, the pressing member movable along the guide member and contacting a rear edge of a sheet stored in the sheet feed cassette; a link cam plate having a long guide groove into which the shaft of the pressing member is movably inserted, the link cam plate being swingably provided on the bottom plate of the sheet feed cassette; and a sheet size detector including a convex portion and a size detector to detect a size of the sheet stored in the sheet feed cassette.

6 Claims, 9 Drawing Sheets

FIG. 8
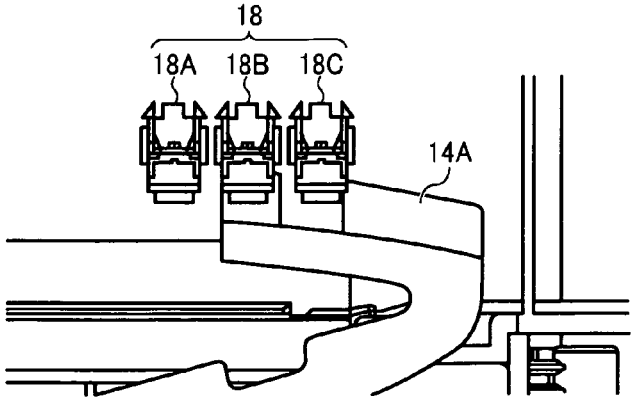
FIG. 9
| SIZE OF SHEET | LIGHT TRANSMISSION / SHIELDING DETECTED BY PHOTOINTERRUPTER | | |
|---|---|---|---|
| | 18A | 18B | 18C |
| A6 | S | T | T |
| A5 | S | S | T |
| B5 | T | S | S |
| LETTER | S | T | S |
| A4 | T | S | T |
| LG | T | T | S |
T = LIGHT TRANSMISSION
S = LIGHT SHIELDING
FIG. 10
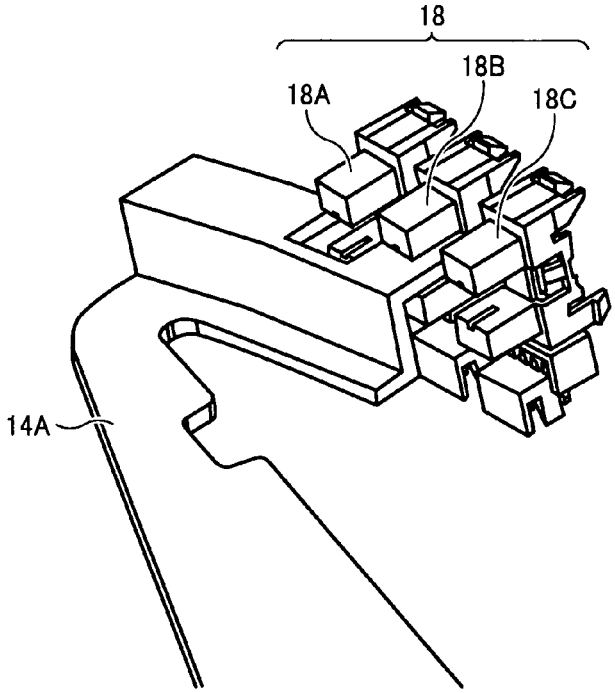

SHEET FEEDING DEVICE AND IMAGE FORMING APPARATUS INCLUDING THE SAME

PRIORITY STATEMENT

The present patent application claims priority from Japanese Patent Application No. 2008-229153, filed on Sep. 6, 2008 in the Japan Patent Office, which is hereby incorporated herein by reference in its entirety.

BACKGROUND

1. Technical Field

Illustrative embodiments described in this patent specification generally relate to a sheet feeding device including a sheet feed cassette to feed a recording medium, and an image forming apparatus including the sheet feeding device.

2. Description of the Related Art

Related-art image forming apparatuses, such as copiers, facsimile machines, printers, or multifunction devices having two or more of copying, printing, scanning, and facsimile functions, typically form a toner image on a recording medium (e.g., a sheet) according to image data using an electrophotographic method. In such a method, for example, a charger charges a surface of a latent image bearing member (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

The image forming apparatuses further include a sheet feeding device including a sheet feed cassette to feed a recording medium such as a sheet to the image forming parts of the apparatuses.

One example of the sheet feeding device includes a configuration designed to detect a size of a sheet stored in a sheet feed cassette without increasing either a size of the sheet feed cassette and a force required to operate an end fence member and without damaging a size detection means. The sheet feed cassette of such a sheet feeding device includes the end fence serving as a rear edge restriction member to restrict a position of a rear edge of the sheet stored in the sheet feed cassette in a direction of sheet feed, and the size detection means having a groove so that the end fence is moved in the direction of sheet feed. The size detection means is swingably provided on a bottom plate of the sheet feed cassette. A pivot of the size detection means is positioned at an edge of the size detection means in a direction of sheet feed, and a free edge thereof is positioned at the other edge where the end fence is moved. A length of the size detection means is extended such that the free edge of the size detection means is positioned at an edge in a direction opposite the direction of sheet feed, and a size detection part is provided at that edge in the direction opposite the direction of sheet feed.

However, in the above-described sheet feeding device, a space for installing the size detection part is required in the direction opposite the direction of sheet feed. Consequently, a size of the sheet feeding device is increased. Further, because a position of the free edge of the size detection means contacting the size detection part is not changed even when the sheet feed cassette is contracted, the size of the sheet feeding device in the direction of sheet feed may not be reduced.

Published unexamined Japanese Utility Model Application No. H06-001349 discloses a sheet feeding device including microswitches that detect a size of a sheet stored in a sheet feed cassette capable of storing sheets having a variety of different sizes. In order to reduce the number of the microswitches, rollers are provided at an edge of a restriction plate that restricts a position of a rear edge of the sheet. Further, linear cam plates are rotatably provided at positions corresponding to the rollers. Each of the linear cam plates is rotated outwardly, and an external protrusion is formed outside of each of the linear cam plates. The microswitches are provided at positions opposite the external protrusions.

However, in the sheet feeding device described above, because a size detection part is positioned in the direction of sheet feed, a space for installing the size detection part in the sheet feeding device is required in the direction of sheet feed, causing an increase in a size of the sheet feeding device.

In yet another approach, a sheet feeding device in which a size detection cam operating in conjunction with an end fence, and a size detection part provided on a lateral surface side of a sheet feed cassette are used for size detection has been proposed.

However, although the size detection part is provided on the lateral surface side of the sheet feed cassette in the above-described sheet feeding device, the sheet feed cassette is not configured to be extended or contracted in the direction of sheet feed. Consequently, an installation area for the sheet feeding device may be larger than the maximum size of the sheet stored in the sheet feed cassette.

SUMMARY

In view of the foregoing, illustrative embodiments described herein provide a sheet feeding device including a sheet feed cassette. The sheet feed cassette includes a link cam plate fitted within the sheet feed cassette even when the sheet feed cassette is contracted. The link cam plate is capable of detecting a size of a recording medium even when the sheet feed cassette is extended. The illustrative embodiments described herein further provide an image forming apparatus including the sheet feeding device.

At least one embodiment provides a sheet feeding device including a sheet feed cassette. The sheet feed cassette includes a tray extendable and contractible in a direction of sheet feed to change a size of the sheet feed cassette depending on a size of a sheet stored in the sheet feed cassette in the direction of sheet feed, and drawable from the sheet feeding device in a direction identical to the direction of sheet feed; a guide member having a long groove provided therein, the guide member provided on a bottom plate of the sheet feed cassette in the direction of sheet feed; a pressing member having a shaft in a lower portion thereof loosely inserted into the guide member, a part of the shaft protruding downward from the bottom plate of the sheet feed cassette, the pressing member movable along the guide member and contacting a rear edge of the sheet stored in the sheet feed cassette in the direction of sheet feed; a link cam plate having a long guide groove into which the shaft of the pressing member is movably inserted, the link cam plate being swingably provided on the bottom plate of the sheet feed cassette; and a sheet size detector including a convex portion provided at an edge of the link cam plate and a size detector provided to the convex portion, each positioned in the direction to which the tray is drawn from the sheet feeding device, the sheet size detector detecting a size of the sheet stored in the sheet feed cassette. The pressing member and the long guide groove of the link cam plate into which the pressing member is movably inserted disengage from each other when the tray is extended.

At least one embodiment provides an image forming apparatus including a latent image bearing member rotated to bear an electrostatic latent image on a surface thereof, a charger to evenly charge the surface of the latent image bearing member, an irradiating device to irradiate a charged surface of the latent image bearing member with a light beam according to image data to form an electrostatic latent image on the charged surface of the latent image bearing member; a developing device to develop the electrostatic latent image with a developer to form a toner image on the charged surface of the latent image bearing member; a transfer device to transfer the toner image onto a sheet; and the sheet feeding device including a sheet feed cassette as described above.

Additional features and advantages of the illustrative embodiments will be more fully apparent from the following detailed description, the accompanying drawings, and the associated claims.

BRIEF DESCRIPTION OF THE DRAWINGS

A more complete appreciation of the illustrative embodiments described herein and the many attendant advantages thereof will be readily obtained as the same becomes better understood by reference to the following detailed description when considered in connection with the accompanying drawings, wherein:

FIG. 8 is an enlarged schematic view illustrating an arm provided to a size detection plate and a group of photointerrupters provided to the arm;

FIG. 9 is a table illustrating a relation between a size of a sheet stored in the sheet feed cassette and light transmission/shielding detected by the group of photointerrupters;

FIG. 10 is an enlarged perspective view illustrating the arm and the group of photointerrupters;

Figure 1:
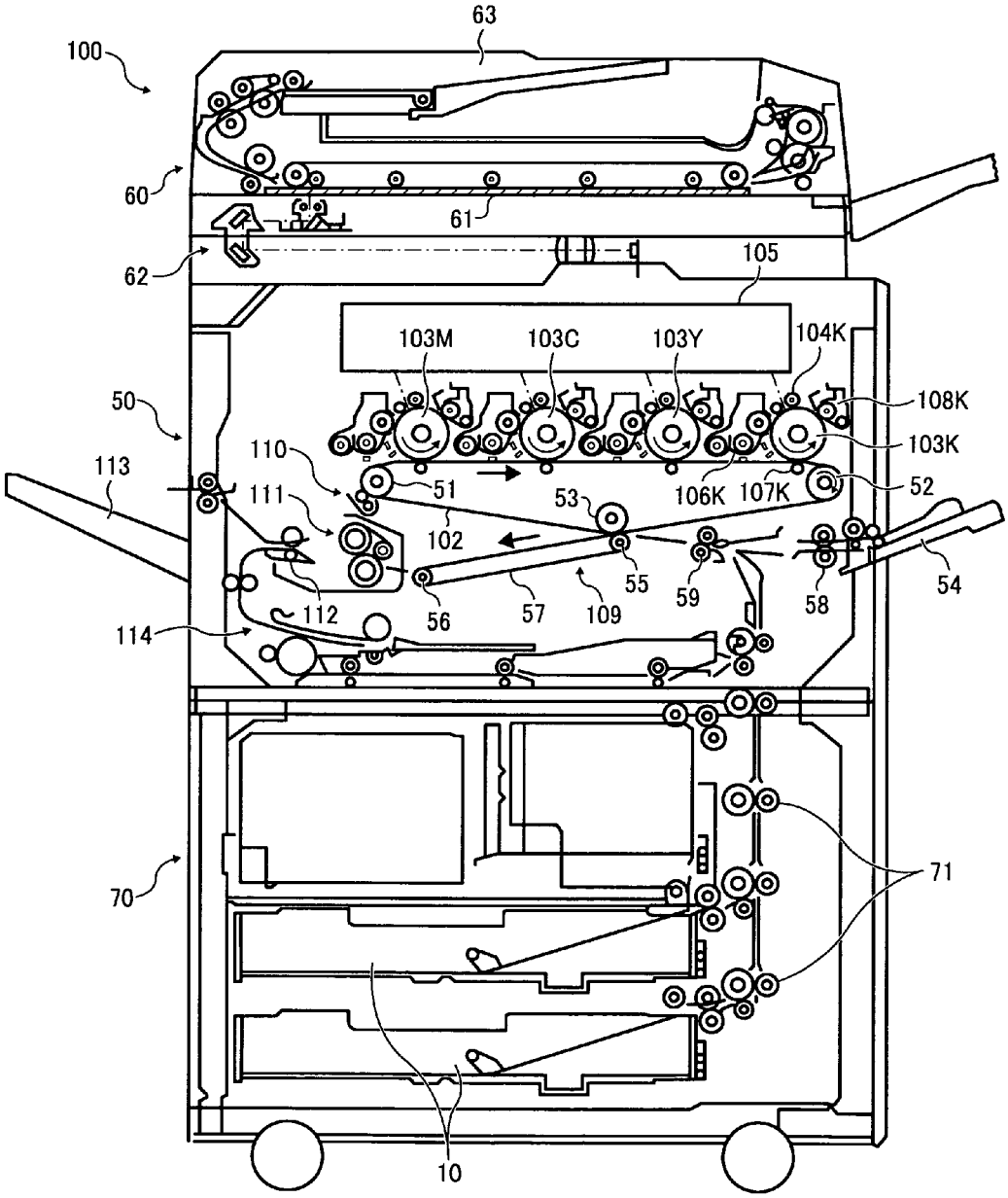
FIG. 1 is a schematic view illustrating an image forming apparatus including a sheet feeding device according to illustrative embodiments.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Reference is now made to the drawings, wherein like reference numerals designate identical or corresponding parts throughout the several views.

FIG. 1 is a schematic view illustrating an image forming apparatus 100 including a sheet feeding device 70 according to illustrative embodiments. The image forming apparatus 100 illustrated in FIG. 1 is a tandem-type full-color image forming apparatus including multiple photoconductors each serving as a latent image bearing member to form images of each color corresponding to separated colors. Toner images formed on each of the multiple photoconductors are sequentially transferred onto an intermediate transfer member in a superimposed manner. The toner images thus superimposed on one another on the intermediate transfer member are further transferred onto a recording medium such as a recording sheet and a transfer sheet (hereinafter referred to as a sheet) to form a full-color image on the sheet. Although the image forming apparatus 100 illustrated in FIG. 1 is a tandem-type full-color image forming apparatus, it is to be noted that illustrative embodiments to be described in detail below are applicable to various image forming apparatuses other than tandem type full-color image forming apparatuses.

Referring to FIG. 1, the image forming apparatus 100 includes an image forming device 50 at a center thereof in a vertical direction. The sheet feeding device 70 is provided below the image forming device 50, and an image scanner 60 including a document stand 61 is provided above the image forming device 50. An intermediate transfer belt 102 having a stretched surface in a horizontal direction is provided in the image forming device 50. The image forming device 50 further includes image forming units that form images of each color complementary to a separated color above the intermediate transfer belt 102.

Specifically, in the image forming device 50, photoconductors 103K, 103Y, 103C, and 103M (hereinafter collectively referred to as photoconductors 103), each capable of bearing a color toner image of either black, yellow, cyan, or magenta, are arranged parallel to one another along the intermediate transfer belt 102. An optical writing unit 105 is provided above the photoconductors 103.

Each of the photoconductors 103 includes a drum, and each drum is rotated in the same direction, that is, a counterclockwise direction in FIG. 1. A charger 104, a developing device 106, a primary transfer device 107, and a cleaning device 108, each performing image formation while each of the photoconductors 103 is rotated, are provided for each of the photoconductors 103. The structures of these devices are the same for each of the image forming units. For convenience, only a charger 104K, a developing device 106K, a primary transfer device 107K, and a cleaning device 108K, each provided around the photoconductor 103K, are shown in FIG. 1.

The intermediate transfer belt 102 serves as a primary transfer member onto which toner images are sequentially transferred from each of image forming units including each of the photoconductors 103. The intermediate transfer belt 102 is wound around multiple rollers 51, 52, and 53, and is moved in the same direction as the direction of rotation of each of the photoconductors 103 at a position contacting the photoconductors 103. In other words, the intermediate transfer belt 102 is rotated in a clockwise direction in FIG. 1. The intermediate transfer belt 102 is stretched around the rollers 51 and 52, and the roller 53 is provided opposite a secondary transfer unit 109 with the intermediate transfer belt 102 disposed therebetween. The image forming device 50 further includes a belt cleaning device 110 to clean the intermediate transfer belt 102.

The secondary transfer unit 109 includes a secondary transfer belt 57 wound around a charge drive roller 55 and a driven roller 56. The secondary transfer belt 57 is rotated in a counterclockwise direction in FIG. 1 to be moved in the same direction as the direction of rotation of the intermediate transfer belt 102 at a secondary transfer position between the roller 53 and the charge drive roller 55. The charge drive roller 55 charges the secondary transfer belt 57 so that a full-color toner image or a monochrome toner image transferred onto the intermediate transfer belt 102 is transferred onto a sheet while the sheet is electrostatically attracted and conveyed by the secondary transfer belt 57.

The sheet is fed from the sheet feeding device 70 to the secondary transfer position. The sheet feeding device 70 includes multiple sheet feed cassettes 10 and multiple conveyance rollers 71 positioned along so as to convey the sheet fed from the sheet feed cassettes 10 along a conveyance path. The sheet is further conveyed from the conveyance rollers 71 to a pair of registration rollers 59 positioned in front of the secondary transfer position. The image forming apparatus 100 further includes a manual sheet feed tray 54 foldably provided on a lateral surface of the image forming device 50 and a corresponding pair of feed rollers 58. A sheet not stored in the sheet feed cassettes 10 in the sheet feeding device 70 can be fed to the secondary transfer position.

A conveyance path for the sheet fed from the manual sheet feed tray 54 joins the conveyance path for the sheet fed from the sheet feed cassettes 10 to the pair of registration rollers 59 at a position in front of the pair of registration rollers 59. Accordingly, the sheet fed from either conveyance path can be conveyed to the secondary transfer position by the pair of registration rollers 59 at a predetermined registration time.

The optical writing unit 105 controls writing light based on image data, either image data obtained by scanning a document placed on the document stand 61 of the image scanner 60 or image data output from a computer or other apparatus, not shown. The writing light thus controlled is directed to each of the photoconductors 103 to form an electrostatic latent image on each of the photoconductors 103 based on the image data.

The image scanner 60 includes a scanner 62 to scan the document placed on the document stand 61, and an automatic document feeder (ADF) 63 provided above the document stand 61. The ADF 63 reverses the document to be conveyed to the document stand 61 so that images on both front and back sides of the document can be scanned.

Each of the electrostatic latent images formed on the photoconductors 103 by the optical writing unit 105 is developed by the developing device 106 using toner, and toner images thus formed on each of the photoconductors 103 are primarily transferred onto the intermediate transfer belt 102. The toner images sequentially transferred onto the intermediate transfer belt 102 in a superimposed manner are then secondarily transferred onto the sheet by the secondary transfer unit 109.

The sheet having the toner image thereon is conveyed to a fixing device 111 so that the toner image is fixed to the sheet. The fixing device 111 employs a belt fixing system. Specifically, the fixing device 111 includes a fixing belt heated by a heat roller, not shown, and a pressing roller, not shown, contacting the fixing belt to form a nip area. As a result, a wider area to heat the sheet can be achieved compared to a roller fixing system.

A direction of conveyance of the sheet passing through the fixing device 111 is changed by a conveyance path changing pick 112 provided at the back of the fixing device 111. Accordingly, the sheet is conveyed to either a discharge tray 113 or a reverse conveyance path 114.

In the image forming apparatus 100 having the above-described configuration, an electrostatic latent image is formed on the photoconductors 103 evenly charged by the chargers 104 based on image data obtained by scanning a document placed on the document stand 61 or image data output from a computer. The electrostatic latent image thus formed is developed by the developing device 106 using toner, and a toner image thus formed is primarily transferred onto the intermediate transfer belt 102.

The toner image primarily transferred onto the intermediate transfer belt 102 is secondarily transferred onto the sheet fed from the sheet feeding device 70 in a case of forming a monochrome image, whereas in a case of forming a full-color image, primary transfer of the toner image is repeatedly performed so that the toner images of each color are superimposed on one another on the intermediate transfer belt 102, and then the toner images are secondarily transferred onto the sheet all at once. The sheet having the toner image thereon is conveyed to the fixing device 111 so that the toner image is fixed to the sheet. Thereafter, the sheet having the fixed toner image thereon is discharged to the discharge tray 113 or reversed to be conveyed to the pair of registration rollers 59 again through the reverse conveyance path 114.

Figure 2:
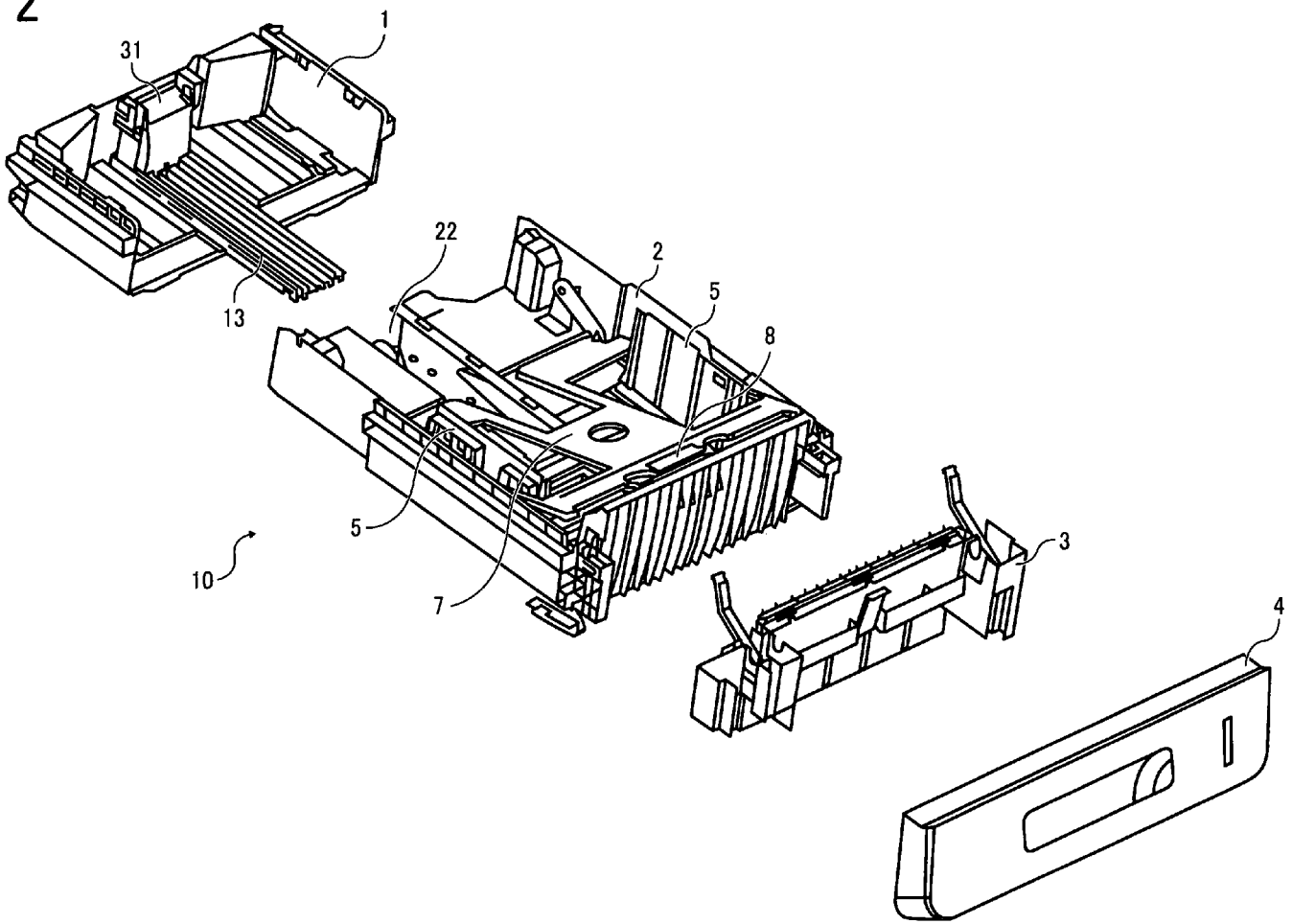
FIG. 2 is an exploded perspective view illustrating a sheet feed cassette included in the sheet feeding device.
Figure 3:
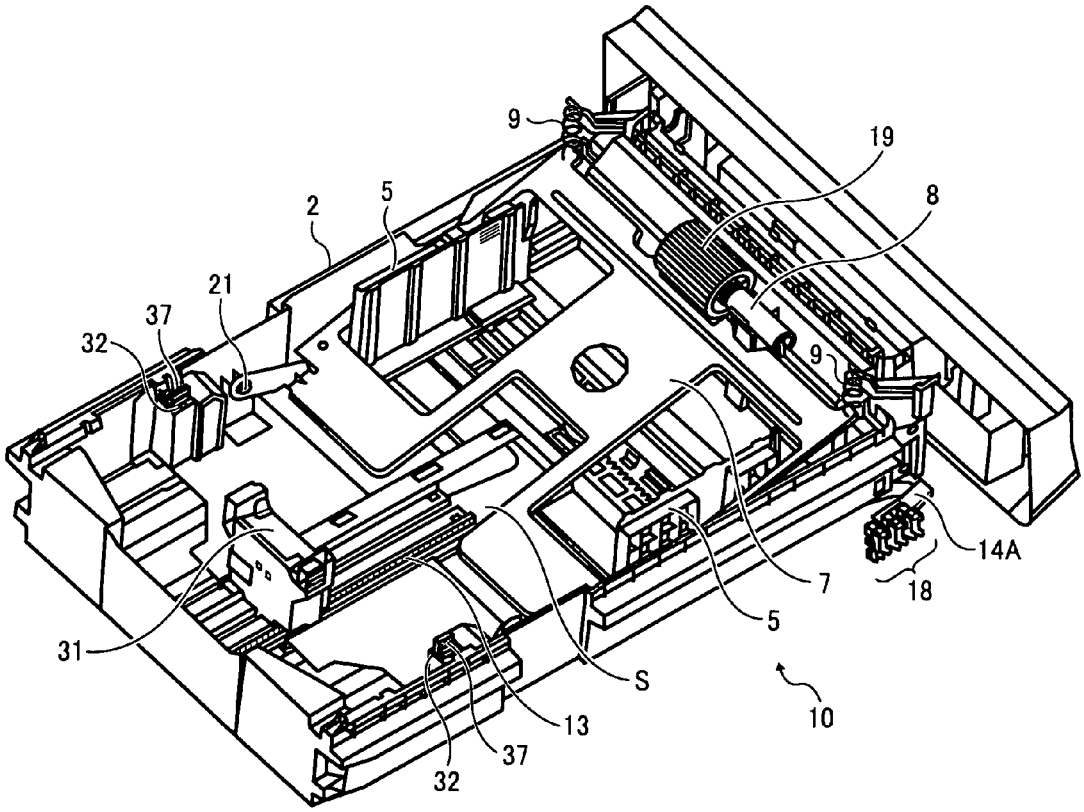
FIG. 3 is a perspective view illustrating the sheet feed cassette.

FIG. 2 is an exploded perspective view illustrating the sheet feed cassette 10, and FIG. 3 is a perspective view illustrating the sheet feed cassette 10. As illustrated in FIG. 2, the sheet feed cassette 10 includes, as main components thereof, a tray extension/contraction part 1, a main body 2, a guide member 3, and an outer part 4.

In FIG. 3, the tray extension/contraction part 1 is extended to the maximum state thereof, and is not contracted according to a size of the sheet stored therein. Referring to FIGS. 2 and 3, the main body 2 includes a pair of side fences 5, a pinion gear, not shown, a storage plate 7, and a friction pad 8 serving as separation means. The pair of side fences 5 includes a rack integrally formed therewith, and is moved relative to each other via the pinion gear engaged with the rack. Accordingly, the pair of side fences 5 can be slid to a position corresponding to a width of the sheet stored in the sheet feed cassette 10, and restricts positions of side edges of the sheet in a width direction thereof to prevent the sheet from being tilted.

A part of the storage plate 7 is fitted with a fulcrum 21 provided to the main body 2, and an edge of the storage plate 7 opposite the part fitted with the fulcrum 21 is lifted by springs 9 to lift the sheet stored in the sheet feed cassette 10. As a result, the sheet stored in the sheet feed cassette 10 is pressed against a sheet feed roller 19 provided to the main body 2.

A part of the tray extension/contraction part 1 is inserted into the main body 2 and slidably attached to the main body 2 to extend or contract the sheet feed cassette 10. A pick provided on an outer surface of a bottom plate of the tray extension/contraction part 1 is inserted into a groove formed on a bottom portion of the main body 2 so that the tray extension/ contraction part 1 is not dropped off from the main body 2 even when the tray extension/contraction part 1 is extended to the maximum state.

The sheet feed cassette 10 includes a configuration to support the tray extension/contraction part 1 at a slide position. Specifically, lock members 37 are provided on inner side surfaces at edges of the main body 2 on a tray extension/contraction part 1 side, and grooves 32 are provided on inner surfaces of side walls of the tray extension/contraction part 1. Each of the lock members 37 includes a protrusion capable of inserted into each of the grooves 32, so that the tray extension/contraction part 1 can be supported at the slide position by inserting each of the protrusions of the lock member 37 into each of the grooves 32. A slit, not shown, is provided on each of the side surfaces of the main body 2 so that each of the protrusions of the lock members 37 can advance or retract to or from each of the grooves 32.

The protrusion provided to the lock member 37 is operated by a user. A support position and a release position of the protrusion are displayed on a surface of the lock member 37 corresponding to a position of the protrusion. Accordingly, the user can confirm whether or not the tray extension/contraction part 1 is supported by checking the display on the lock member 37, so that the tray extension/contraction part 1 is not slid unless otherwise slid by the user.

When a size of the sheet stored in the sheet feed cassette 10 is fixed and the tray extension/contraction part 1 does not need to be slid, a blinder is provided to cover the display of the lock member 37. As a result, the user can easily confirm that the sheet feed cassette 10 stores the sheet having a fixed size.

The tray extension/contraction part 1 includes an end fence guide 13. A bottom portion of an end fence 31 (i.e., pressing member 31) serving as a restriction member that restricts a rear edge of the sheet stored in the sheet feed cassette 10 is fitted with the end fence guide 13, so that the end fence 31 can be slid in a direction of extension/contraction of the tray extension/contraction part 1 at a center of a direction perpendicular to the direction of extension/contraction of the tray extension/contraction part 1, that is, a center in a width direction of the sheet.

Figure 4:
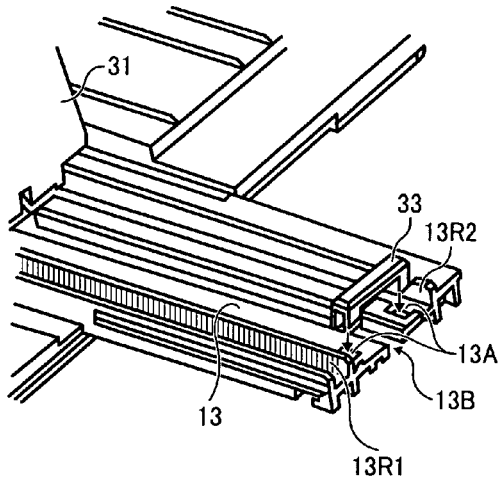
FIG. 4 is a perspective view illustrating an end fence guide provided to the sheet feed cassette.

FIG. 4 is a perspective view illustrating the end fence guide 13. As illustrated in FIG. 4, the end fence guide 13 includes a long central groove 13B at a center thereof extending in a direction perpendicular to the direction of extension/contraction of the tray extension/contraction part 1. A pin, not shown, provided at a bottom surface of the end fence 31 is inserted into the long central groove 13B so that the end fence 31 is moved along the long central groove 13B. In other words, the end fence guide 13 serves as a slide guide member.

A pair of rails 13R1 and 13R2 is respectively provided on both sides of the long central groove 13B. The bottom surface of the end fence 31 is placed on the pair of rails 13R1 and 13R2 so that the end fence 31 can be moved on the pair of rails 13R1 and 13R2. The rail 13R1 includes a rack capable of engaging an engagement member, not shown, provided to the end fence 31. After the end fence 31 is moved to a position to restrict the position of the rear edge of the sheet stored in the sheet feed cassette 10, the engagement member is engaged with the rack provided to the rail 13R1 to keep the end fence 31 at that position.

The maximum extendable length of the end fence guide 13 is predetermined, and an edge of the end fence guide 13 is fitted within a cutout 22 formed at the bottom of the main body 2 when contracted to the minimum length. As described above, the end fence guide 13 includes the pair of rails 13R1 and 13R2 with which the bottom surface of the end fence 31 is fitted at each side of the long central groove 13B. As a result, a distance between the pair of rails 13R1 and 13R2 at that edge of the end fence guide 13 fitted within the cutout 22 of the main body 2 is not fixed.

In order to prevent a distance change between the pair of the rails 13R1 and 13R1, engagement holes 13A are provided on an upper surface of that edge of the end fence guide 13. A prevention member 33 provided across the pair of the rails 13R1 and 13R2 is engaged with each of the engagement holes 13A so that the distance change between the pair of rails 13R1 and 13R2 can be prevented.

Figure 5:
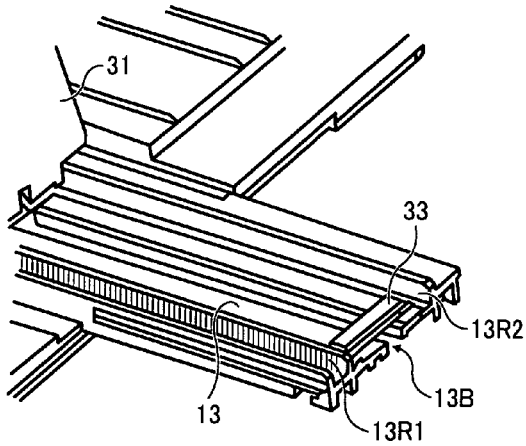
FIG. 5 is a perspective view illustrating a state in which a prevention member is engaged with engagement holes.

FIG. 5 is a perspective view illustrating a state in which the prevention member 33 is engaged with each of the engagement holes 13A. The prevention member 33 prevents the end fence 31 from dropping off from the edge of the end fence guide 13 when the tray extension/contraction part 1 is extended and the edge of the end fence guide 13 is separated from the cutout 22 of the main body 2. Further, in a case in which the edge of the pair of rails 13R1 and 13R2 is smaller than the cutout 22, the prevention member 33 prevents the distance between the pair of rails 13R1 and 13R2 from being changed within a difference in size between the edge of the pair of rails 13R1 and 13R2 and the cutout 22. As a result, the end fence 31 is prevented from dropping off from the pair of rails 13R1 and 13R2.

Because the maximum extendable length of the end fence guide 13 is predetermined as described above, when the tray extension/contraction part 1 is slid to the maximum extent, a space S is generated between the main body 2 and the edge of the end fence guide 13 within the cutout 22. An auxiliary rail 12 serving as an auxiliary member illustrated in FIG. 6 can be provided to the edge of the end fence guide 13 to fill the space S. Accordingly, an overall length of the end fence guide 13 can be extended.

Figure 6:
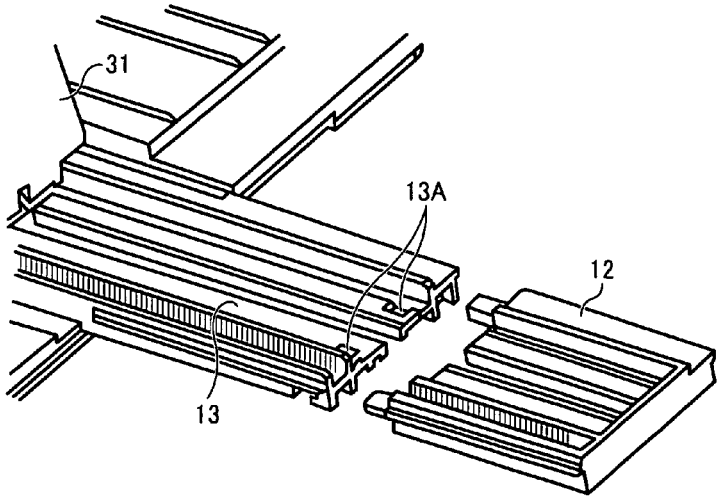
FIG. 6 is an exploded perspective view illustrating an auxiliary rail used for extending a length of the end fence guide.

As described above, the auxiliary rail 12 is used for extending the length of the end fence guide. As illustrated in FIG. 6, the auxiliary rail 12 is detachably attachable to the edge of the end fence guide 13 including the pair of rails 13R1 and 13R2 for guiding the end fence 31 so that the space S generated within the cutout 22 is filled with the auxiliary rail 12. Accordingly, a distance of movement of the end fence 31 can be elongated by attachment of the auxiliary rail 12 even when the tray extension/contraction part 1 is extended to the maximum extent. As a result, the end fence 31 can be moved to an arbitrary position within a range in which the rear edge of the sheet having a small size stored in the sheet feed cassette 10 contracted to the minimum length can be restricted even when the tray extraction/contraction part 1 is extended to the maximum extent.

An edge of the auxiliary rail 12 in the cutout 22 of the main body 2 is arranged to contact an inner edge of the cutout 22. As a result, the cutout 22 of the main body 2 is filled with the auxiliary rail 12, restricting unnecessary movement of the tray extraction/contraction part 1 in a direction of contraction.

Figure 7:
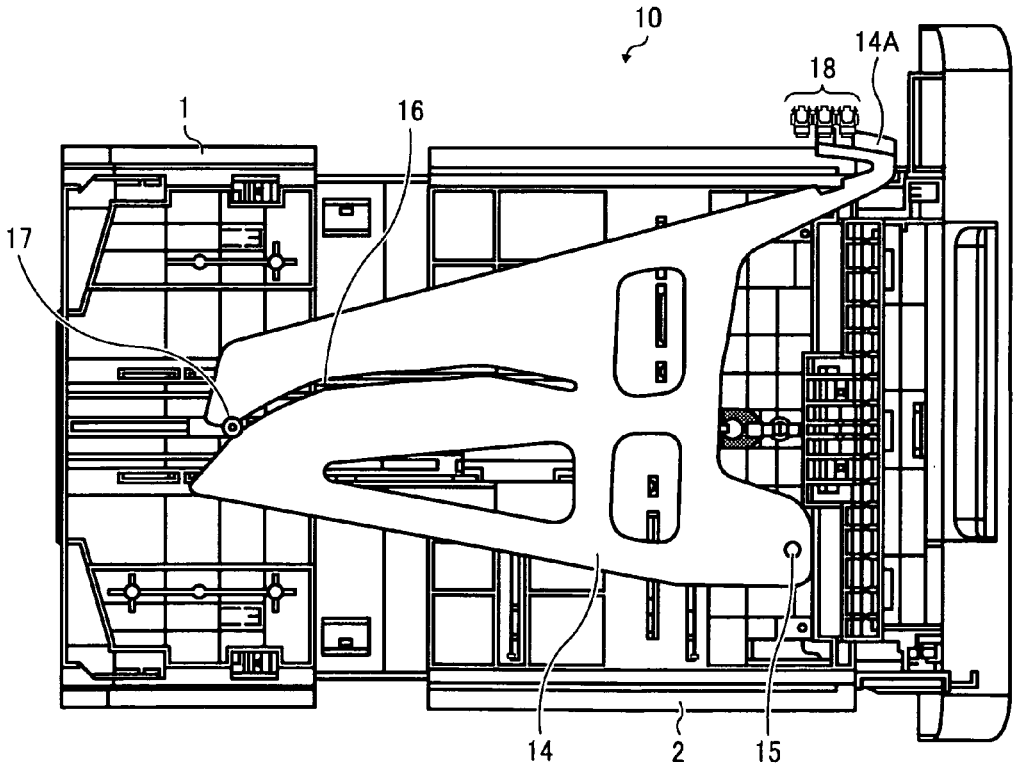
FIG. 7 is a plan view illustrating an example of a size detection mechanism included in the sheet feed cassette.

FIG. 7 is a plan view illustrating an example of a size detection mechanism included in the sheet feed cassette 10. Referring to FIG. 7, a size detection plate 14 (i.e., link cam plate 14) serving as size detection means is provided on a bottom surface of the main body 2. The size detection plate 14 is swingable around a pin 15 provided as a pivot at an edge of the main body 2 in a direction of sheet feed.

A free edge of the size detection plate 14 is provided on a side opposite a pivot side, and swings toward the side walls of the tray extraction/contraction part 1, that is, in a lateral direction relative to the direction of sheet feed. A guide groove 16 is provided between the pivot and the free edge of the size detection plate 14, and into this guide groove 16 is inserted a swing pin 17 (i.e., shaft 17) integrally formed with a bottom part (e.g., in a lower portion) of the end fence 31. The guide groove 16 is formed in a shape that allows the size detection plate 14 to swing in accordance with movement of the swing pin 17. The swinging movement of the size detection plate 14 is detected by a position detector assembly consisting of an arm 14A provided at an edge of the size detection plate 14 and a group of photointerrupters 18 provided to the arm 14A. The group of photointerrupters 18 is arranged along a direction or arc through which the arm 14A is moved as the size detection plate 14 swings. Movement of the size detection plate 14 is detected by the group of photointerrupters 18 detecting whether or not light emitted therefrom is shielded by the arm 14A, whose position changes in accordance with the swinging movement of the size detection plate 14. As a result, a position of the size detection plate 14 swinging in accordance with the position of the end fence 31 is detected, so that the size of the sheet stored in the sheet feed cassette 10 can be detected.

FIG. 8 is an enlarged schematic view illustrating the arm 14A and the group of photointerrupters 18. FIG. 9 is a table illustrating a relation between the size of the sheet stored in the sheet feed cassette 10 and light transmission/shielding detected by the group of photointerrupters 18. FIG. 10 is an enlarged perspective view illustrating the arm 14A and the group of photointerrupters 18.

The group of photointerrupters 18 includes photointerrupters 18A to 18C. Each of the photointerrupters 18A to 18C detects whether or not light emitted therefrom is shielded by arm 14A. A size of the sheet stored in the sheet feed cassette 10 can be determined based on detection results illustrated in FIG. 9.

A size of the sheet stored in the sheet feed cassette 10 is detected by the arm 14A having a swing radius along the direction of extraction/contraction of the sheet feed cassette 10. Accordingly, no space is needed for the size detection plate 14 at the back of the sheet feed cassette 10 in the direction of extraction/contraction of the sheet feed cassette 10. As a result, a size of the sheet feeding device 70 including the sheet feed cassette 10 can be reduced in the direction of extension/contraction of the sheet feed cassette 10.

Figure 11:
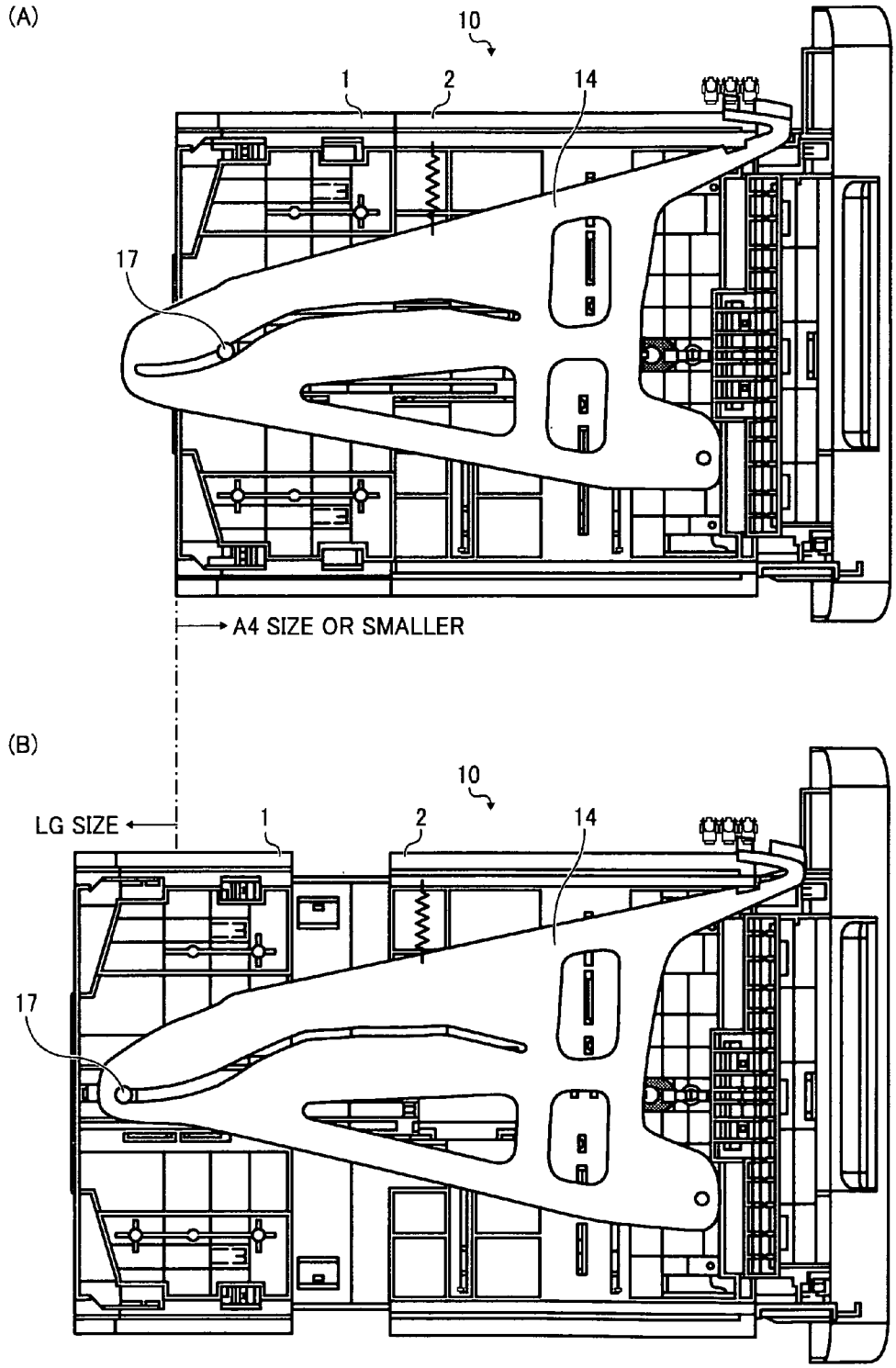
FIGS. 11(A) and 11(B) are plan views illustrating an example of an extended state and a contracted state of the sheet feed cassette, respectively.

As described above, the sheet feed cassette 10 can be extended or contracted depending on the size of the sheet stored therein. For example, when a sheet having a long size (hereinafter referred to as an LG size) is not stored in the sheet feed cassette 10, that is, when a sheet having an A4 size or a size smaller than the A4 size is stored in the sheet feed cassette 10, the sheet feed cassette 10 is contracted as illustrated in FIG. 11(A). By contrast, when the sheet having the LG size is stored in the sheet feed cassette, the sheet feed cassette 10 can be extended as illustrated in FIG. 11(B). In other words, the size of the sheet feed cassette 10 can be changed depending on the size of the sheet stored therein.

In the above-described case in which the size of the sheet feed cassette 10 is changed, a size of the size detection plate 14 becomes a problem. Specifically, when the sheet having the LG size is stored in the sheet feed cassette, the end fence 31 needs to be moved to the back of the sheet feed cassette 10, and the swing pin 17 provided at the bottom part of the end fence 31 is also moved to the back of the sheet feed cassette 10. In order to swing the size detection plate 14 in accordance with movement of the swing pin 17, the size of the size detection plate 14 is required to be extended to reach the swing pin 17 as illustrated in FIG. 11(B). Consequently, a part of the size detection plate 14 lies off the sheet feed cassette 10 as illustrated in FIG. 11(A) when the sheet having the A4 size or the size smaller than the A4 size is stored in the sheet feed cassette 10 and the tray extension/contraction part 1 is contracted.

To solve the above-described problem, the size detection plate 14 is formed to fit into the sheet feed cassette 10 even when the sheet feed cassette 10 is contracted.

Figure 12:
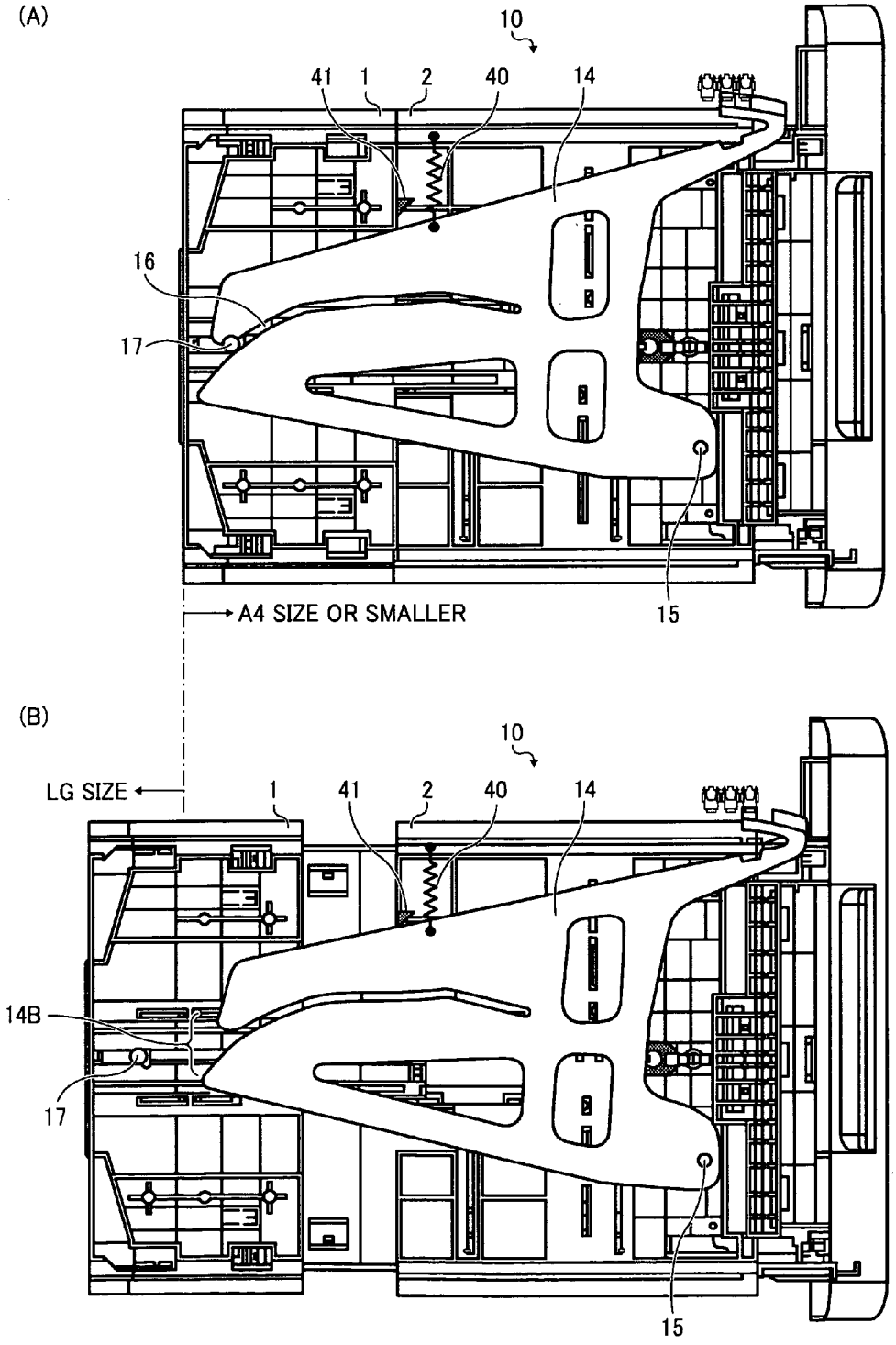
FIGS. 12(A) and 12(B) are plan views illustrating the sheet feed cassette in an extended state and a contracted state, respectively, according to illustrative embodiments.

FIG. 12(A) is a plan view illustrating an example of the sheet feed cassette 10 when the tray extension/contraction part 1 is contracted. In FIG. 12(A), the swing pin 17 of the end fence 31 is positioned at a position for the A4 size. In this case, the size detection plate 14 fits into the sheet feed cassette 10 and the swing pin 17 is inserted into the guide groove 16 of the size detection plate 14.

FIG. 12(B) is a plan view illustrating the sheet feed cassette 10 when the tray extension/contraction part 1 is extended to store the sheet having the LG size. In FIG. 12(B), when the end fence 31 is positioned at a position for the LG size, the swing pin 17 is separated from the guide grove 16 of the size detection plate 14. At this time, the size detection plate 14 is biased by a spring 40, one end of which is attached to the main body 2 and the other end of which is attached to the size detection plate 14. Further, a stopper 41 is provided to the main body 2. Accordingly, the position of the size detection plate 14 is not changed even when the swing pin 17 is separated from the size detection plate 14. As a result, when the end fence 31 is positioned at the position for the LG size, the arm 14A can be kept at the position for the LG size, so that the group of photointerrupters 18 reliably detects the size of the sheet having the LG size.

A wider entrance and taper is provided to an insertion opening 14B of the size detection plate 14 as illustrated in FIG. 12(B) to reliably accommodate the swing pin 17 within the guide groove 16 when the sheet having the A4 size or the size smaller than the A4 size is stored in the sheet feed cassette 10 and the swing pin 17 separated from the size detection plate 14 is returned to the guide groove 16 of the size detection plate 14.

A description is now given of the size detection mechanism according to a second illustrative embodiment.

Figure 13:
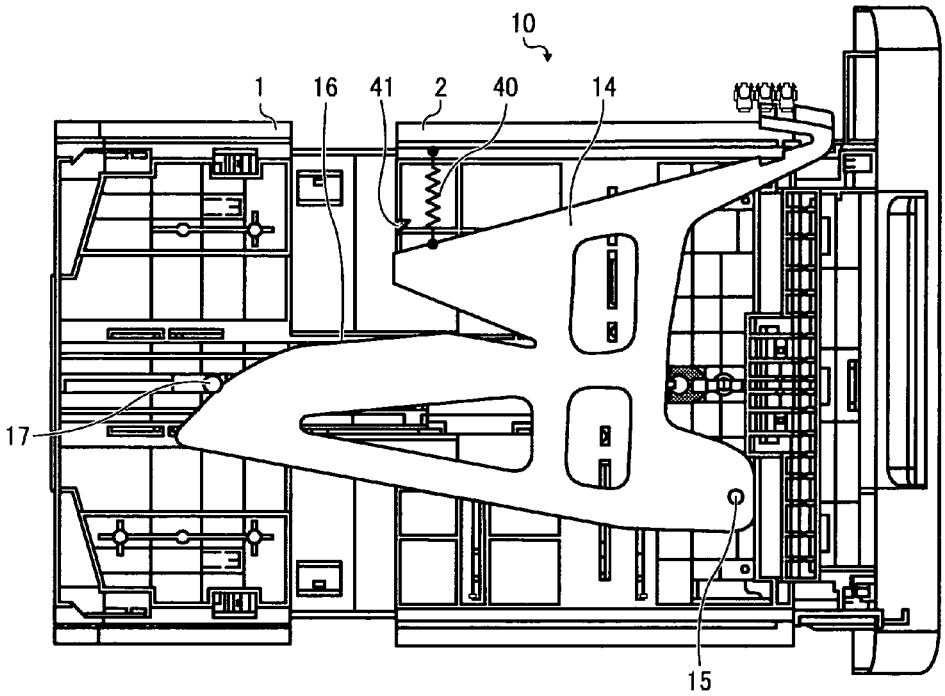
FIG. 13 is a plan view illustrating a size detection mechanism included in a sheet feed cassette according to a second illustrative embodiment.

Because the size detection plate 14 is biased in one direction by the spring 40, a guide member that guides the size detection plate 14 toward only a direction opposite the direction biased by the spring 40 can serve as the guide groove 16. FIG. 13 is a plan view illustrating the guide groove 16 of the size detection plate 14 included in the sheet feed cassette 10 according to the second illustrative embodiment.

A description is now given of reinforcement of the sheet feed cassette 10 to prevent disengagement of the size detection plate 14.

Figure 14:
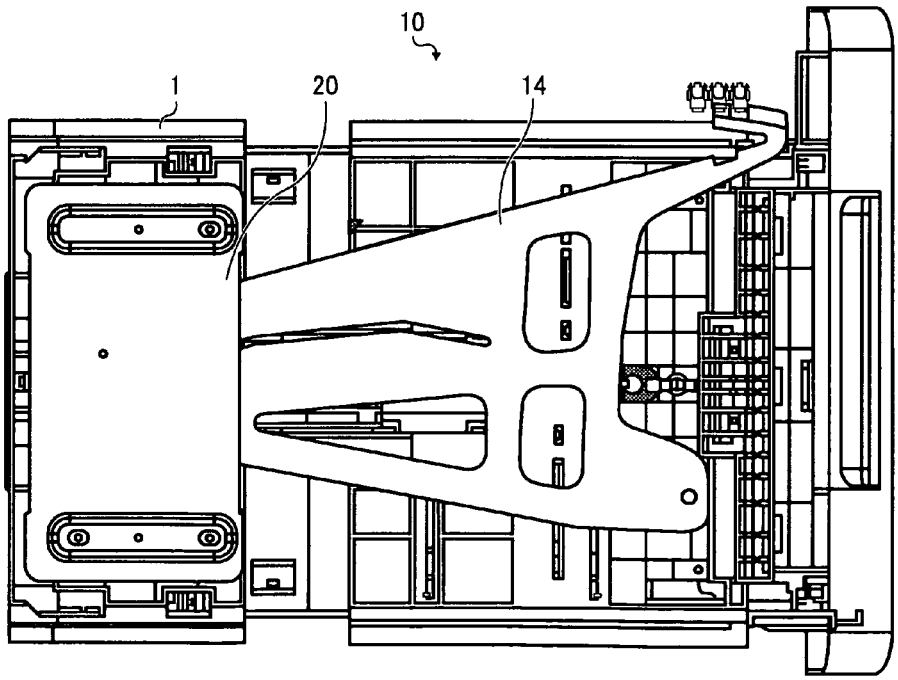
FIG. 14 is a plan view illustrating the sheet feed cassette including a reinforcing member.

FIG. 14 is a plan view illustrating the sheet feed cassette 10 having a reinforcing member 20, specifically, a reinforcing member 20 that prevents the tray extraction/contraction part 1 from widening in a width direction of the sheet stored in the sheet feed cassette 10 provided to the tray extraction/contraction part 1.

As described above, in the tray extraction/contraction part 1, the end fence guide 13 includes the pair of the rails 13R1 and 13R2, and a groove between the pair of rails 13R1 and 13R2 serves as the long central groove 13B to guide the end fence 31. Consequently, a thickness of the tray extension/contraction part 1 is reduced in the width direction of the sheet stored in the sheet feed cassette 10, that is, a direction perpendicular to the direction of extension/contraction of the tray extension/contraction part 1. In other words, a part of a bottom surface of the tray extension/contraction part 1 is not integrally formed with the bottom surface thereof. Consequently, when the tray extension/contraction part 1 is formed of a resin, a width of the tray extension/contraction part 1 may be increased in the width direction of the sheet stored in the sheet feed cassette 10 because a terminal part of the end fence guide 13 is free. Further, the tray extension/contraction part 1 may rattle due to a lack of rigidity.

To solve the above-described problems, the reinforcing member 20 is provided across the end fence guide 13 that guides the end fence 31 along the width direction of the sheet stored in the sheet feed cassette 10 perpendicular to the direction of extension/contraction of the tray extension/contraction part 1. Accordingly, the width of the tray extension/contraction part 1 is prevented from being increased in the direction perpendicular to the direction of extension/contraction of the tray extension/contraction part 1, preventing deformation of the tray extension/contraction part 1. Accordingly, the size of the sheet stored in the sheet feed cassette 10 can be reliably detected.

Moreover, the reinforcing member 20 includes a sheet metal member for greater rigidity. A positioning pin, not shown, provided at both edges of the reinforcing member 20 in an extended direction thereof is fitted into a positioning hole, not shown, provided to the tray extension/contraction part 1 to fix the reinforcing member 20 to the tray extension/contraction part 1.

The reinforcing member 20 is provided to the sheet feed cassette 10 with a space between the bottom surface of the tray extension/contraction part 1 and the reinforcing member 20, and the size detection plate 14 is inserted within that space. Accordingly, the reinforcing member 20 is used as a guide for the size detection plate 14 in a vertical direction.

According to the foregoing illustrative embodiments, the size detection plate 14 fitted within the sheet feed cassette 10 when the tray extension/contraction part 1 is contracted can function as the size detection means even when the tray extension/contraction part 1 is extended. Further, a projection area of an installation space of the sheet feeding device 70 is smaller than a projection area of the sheet feed tray 10 when the tray extension/contraction part 1 is extended. When a size of the sheet stored in the sheet feed cassette 10 is small enough to be stored in the sheet feed cassette 10 of which tray extension/contraction part 1 is contracted, the size detection mechanism can be contained within the projection area of the installation space of the sheet feeding device 70, resulting in space saving.

As described above, the swing pin 17 separated from the guide groove 16 of the size detection plate 14 when the tray extension/contraction part 1 is extended is reliably returned into the guide groove 16. As a result, the relative positions of the arm 14A and the group of photointerrupters 18 is kept constant, and as a result the size of the sheet stored in the sheet feed cassette 10 can be reliably detected.

Further, the position detector assembly, that is, the arm 14A and the group of photointerrupters 18, is provided at a position to minimize a size of the sheet feed cassette 10 in the direction of sheet feed, preventing an increase in a size of the sheet feeding device 70 in the direction of sheet feed.

Accordingly, the image forming apparatus 100 including the sheet feeding device 70 according to the foregoing illustrative embodiments requires less installation space.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

What is claimed is:

1. A sheet feeding device comprising a sheet feed cassette, the sheet feed cassette comprising:

a tray extendable and contractible in a direction of sheet feed to change a size of the sheet feed cassette depending on a size of a sheet stored in the sheet feed cassette in the direction of sheet feed, and drawable from the sheet feeding device in a direction identical to the direction of sheet feed;

a guide member having a long groove provided therein, the guide member provided on a bottom plate of the sheet feed cassette in the direction of sheet feed;

a pressing member having a shaft in a lower portion thereof loosely inserted into the guide member, a part of the shaft protruding downward from the bottom plate of the sheet feed cassette, the pressing member movable along the guide member and contacting a rear edge of the sheet stored in the sheet feed cassette in the direction of sheet feed;

a link cam plate having a long guide groove into which the shaft of the pressing member is movably inserted, the link cam plate swingably provided on the bottom plate of the sheet feed cassette; and a sheet size detector comprising a convex portion provided at an edge of the link cam plate and a size detector provided to the convex portion, each positioned in the direction to which the tray is drawn from the sheet feeding device, the sheet size detector detecting the size of the sheet stored in the sheet feed cassette, wherein the pressing member and the long guide groove of the link cam plate into which the pressing member is movably inserted disengage from each other when the tray is extended.

2. The sheet feeding device comprising a sheet feed cassette according to claim 1, further comprising a biasing member to bias the link cam plate in one direction to fix a position of the link cam plate when the pressing member and the long guide groove of the link cam plate disengage from each other when the tray is extended.

3. The sheet feeding device comprising a sheet feed cassette according to claim 1, wherein the link cam plate does not protrude from a rear end of the sheet feed cassette when the tray is contracted.

4. The sheet feeding device comprising a sheet feed cassette according to claim 1, wherein the convex portion and the size detector are positioned on a lateral surface side of the sheet feed cassette in the direction of sheet feed.

5. An image forming apparatus, comprising:

a latent image bearing member rotated to bear an electrostatic latent image on a surface thereof;

a charger to evenly charge the surface of the latent image bearing member;

an irradiating device to irradiate a charged surface of the latent image bearing member with a light beam according to image data to form the electrostatic latent image on the charged surface of the latent image bearing member;

a developing device to develop the electrostatic latent image with a developer to form a toner image on the charged surface of the latent image bearing member;

a transfer device to transfer the toner image onto a sheet; and a sheet feeding device comprising a sheet feed cassette to feed the sheet, the sheet feed cassette comprising:

a tray extendable and contractible in a direction of sheet feed to change a size of the sheet feed cassette depending on a size of a sheet stored in the sheet feed cassette in the direction of sheet feed, and drawable from the sheet feeding device in a direction identical to the direction of sheet feed;

a guide member having a long groove provided therein, the guide member provided on a bottom plate of the sheet feed cassette in the direction of sheet feed;

a pressing member having a shaft in a lower portion thereof loosely inserted into the guide member, a part of the shaft protruding downward from the bottom plate of the sheet feed cassette, the pressing member movable along the guide member and contacting a rear edge of the sheet stored in the sheet feed cassette in the direction of sheet feed;

a link cam plate having a long guide groove into which the shaft of the pressing member is movably inserted, the link cam plate swingably provided on the bottom plate of the sheet feed cassette; and a sheet size detector comprising a convex portion provided at an edge of the link cam plate and a size detector provided to the convex portion, each positioned in the direction to which the tray is drawn from the sheet feeding device, the sheet size detector detecting the size of the sheet stored in the sheet feed cassette, wherein the pressing member and the long guide groove of the link cam plate into which the pressing member is movably inserted disengage from each other when the tray is extended.

6. The image forming apparatus according to claim 5, wherein the image forming apparatus is a copier, a facsimile machine, a printer, an inkjet recording device, or a multifunction device having two or more functions of the copier, the facsimile machine, the printer, and the inkjet recording device.

* * * * *